US009531123B1

(12) United States Patent
Lanzotti et al.

(10) Patent No.: US 9,531,123 B1
(45) Date of Patent: Dec. 27, 2016

(54) CONNECTOR HOUSING WITH CLIP HAVING A SHOULDER AND PASS-THROUGH SLOT

(71) Applicant: Sumitomo Wiring Systems, Ltd., Yokkaichi, Mie (JP)

(72) Inventors: Joseph Lanzotti, Grosse Pointe, MI (US); Alex Hsieh, Commerce Township, MI (US)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 14/992,579

(22) Filed: Jan. 11, 2016

(51) Int. Cl.
*H01R 13/64* (2006.01)
*H01R 13/631* (2006.01)

(52) U.S. Cl.
CPC ..... *H01R 13/631* (2013.01)

(58) Field of Classification Search
CPC ... H01R 13/631; H01R 13/4538; H01R 13/64; H01R 23/688
See application file for complete search history.

(56) References Cited

U.S. PATENT DOCUMENTS

| | | | | |
|---|---|---|---|---|
| 7,690,946 | B2 * | 4/2010 | Knaub | H01R 23/688 439/607.07 |
| 7,699,632 | B2 * | 4/2010 | Hiramatsu | H01R 13/64 439/246 |
| 9,099,808 | B2 * | 8/2015 | Kato | H01R 13/4538 |
| 9,431,749 | B2 * | 8/2016 | Mingo | H01R 13/4538 |
| 2006/0205264 | A1 | 9/2006 | Katsuma | |

FOREIGN PATENT DOCUMENTS

JP 2014-241253 A 12/2014

* cited by examiner

*Primary Examiner* — Jean F Duverne
(74) *Attorney, Agent, or Firm* — Dinsmore & Shohl LLP

(57) ABSTRACT

A connector housing having a pair of side walls, a pair of end walls and a bottom wall defining an inner space having a top opening is provided. The connector housing includes a first clip disposed on side wall and a second clip disposed on the other side wall, opposite the first clip. The first and second clips include elongated members each having respective first and second blade slots for engaging a stabilizer blade. The second clip includes a neck disposed on a distal end of the second elongated member. The neck defining a pair of shoulders. The second clip further includes a pass-through slot disposed between the neck and the top opening of the housing. The pass-through slot and the shoulders providing space for a tool to form engagement features on the first clip so as to reduce a number of tool dies needed to form the connector housing.

14 Claims, 6 Drawing Sheets

CONNECTOR HOUSING WITH CLIP HAVING A SHOULDER AND PASS-THROUGH SLOT

FIELD OF THE INVENTION

The present invention is related to a connector housing and a connector assembly configured to house a stabilizer blade wherein a pair of shoulders and a pass-through slot on one clip provides space for a tool to make engagement features on an opposite clip so as to reduce the number of tools required to make the connector housing/connector assembly.

BACKGROUND OF THE INVENTION

Connector assemblies are currently known and used. Connector assemblies connect terminal ends of a cable or an electrical wire together so as to supply an electric signal from a source to a component. Connector assemblies include a male housing configured to be seated within a female housing.

Some connector assemblies are configured to hold a blade stabilizer. The blade stabilizer includes a plurality of through-holes for receiving terminal blades of respective male or female terminal connectors. The stabilizer blades are held in place by clips formed on opposite side walls of the connector housing. The clips include engagement features formed on an interior surface of the respective clips. The engagement features are configured to hold the stabilizer in a generally horizontal position so as to be spaced apart from and parallel to the bottom wall of the housing.

Currently, at least four dies are required to form the connector housing as certain features of the connector housing would create a die lock condition if fewer than four dies are used. The number of dies increases production costs as well as complicates the production process. Accordingly, it remains desirable to have a connector house and/or connector assembly configured to reduce the number of dies without decreasing the engagement features of the connector housing between the clips and the blade stabilizer.

SUMMARY OF THE INVENTION

A connector housing having a pair of clips for engaging a blade stabilizer within an inner space of the housing is provided. The connector housing is configured to reduce the number of dies needed to form the engagement features of the clips so as to reduce manufacturing costs and simplify production of the connector housing.

The connector housing includes a pair of side walls, a bottom wall and a pair of end walls so as to define an inner space having a top opening. The connector housing further includes a first clip disposed on one of the pair of side walls. The first clip includes a first elongated member. The first elongated member includes a first interior surface in open communication with the inner space. A first peripheral edge of the first clip is spaced apart from the side wall so as to define a slot extending along the sides and bottom edge of the first clip. The first clip further includes a first guide member and a pair of stops. The pair of stops is disposed on the first peripheral edge of the first elongated member and opposite of each other.

The connector housing includes a second clip disposed on a side wall, opposite of the first clip. The second clip includes a second elongated member. The second elongated member has a second interior surface in open communication with the inner space. The second clip further includes a neck disposed on a distal end of the elongated member so as to define a pair of shoulders on opposite sides of the neck.

The second clip further including a pass-through slot. The pass-through slot is disposed between the neck and the top opening of the housing. The pass-through slot and the shoulders allow a die to form the engagement features on the interior surface of the first clip so as to reduce the number of tool dies needed to form the connector housing.

A connector assembly configured to house terminal connections is also provided. The terminal connections include a plurality of blades for guiding a male terminal connector into a female terminal connector. The connector assembly includes a blade stabilizer for providing axial rigidity to the blades. The blade stabilizer is a generally planar member having a plurality of through-holes for receiving a respective one of the plurality of blades. The blade stabilizer has a first edge opposite a second edge;

The connector assembly further includes a connector housing. The connector housing includes a pair of side walls, a pair of end walls and a bottom wall defining an inner space having a top opening.

The connector housing further includes a first clip and a second clip. The first clip is disposed on one of the pair of side walls and the second clip is disposed on the other of the pair of side walls so as to be opposite the first clip.

The first clip includes a first elongated member having a first interior surface in open communication with the inner space of the housing. The first clip has a first peripheral edge. The first peripheral edge of the first clip is spaced apart from the pair of side wall. The first clip further includes a first guide member spaced apart from a pair of stops so as to define a first blade slot. The pair of stops is disposed on the first peripheral edge of the first elongated member and opposite of each other.

The second clip includes a second elongated member having a second interior surface in open communication with the inner space. A neck is disposed on a distal end of the elongated member so as to define a pair of shoulders on opposite sides of the neck. The second clip further includes a pass-through slot. The pass-through slot is disposed between the neck and the top opening of the housing.

The second clip further includes a second guide member opposite the first guide member. The second guide member has a bottom edge contiguous with the pass-through slot. The bottom edge is spaced apart from the second front wall of the shoulders so as to define a second blade slot. The first blade slot is configured to engage the first blade edge and the second blade slot is configured to engage the second blade edge so as to hold the blade stabilizer in a generally horizontal position so as to be generally parallel to and spaced apart from the bottom wall.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE PREFERRED EMBODIMENTS

Figure 1:
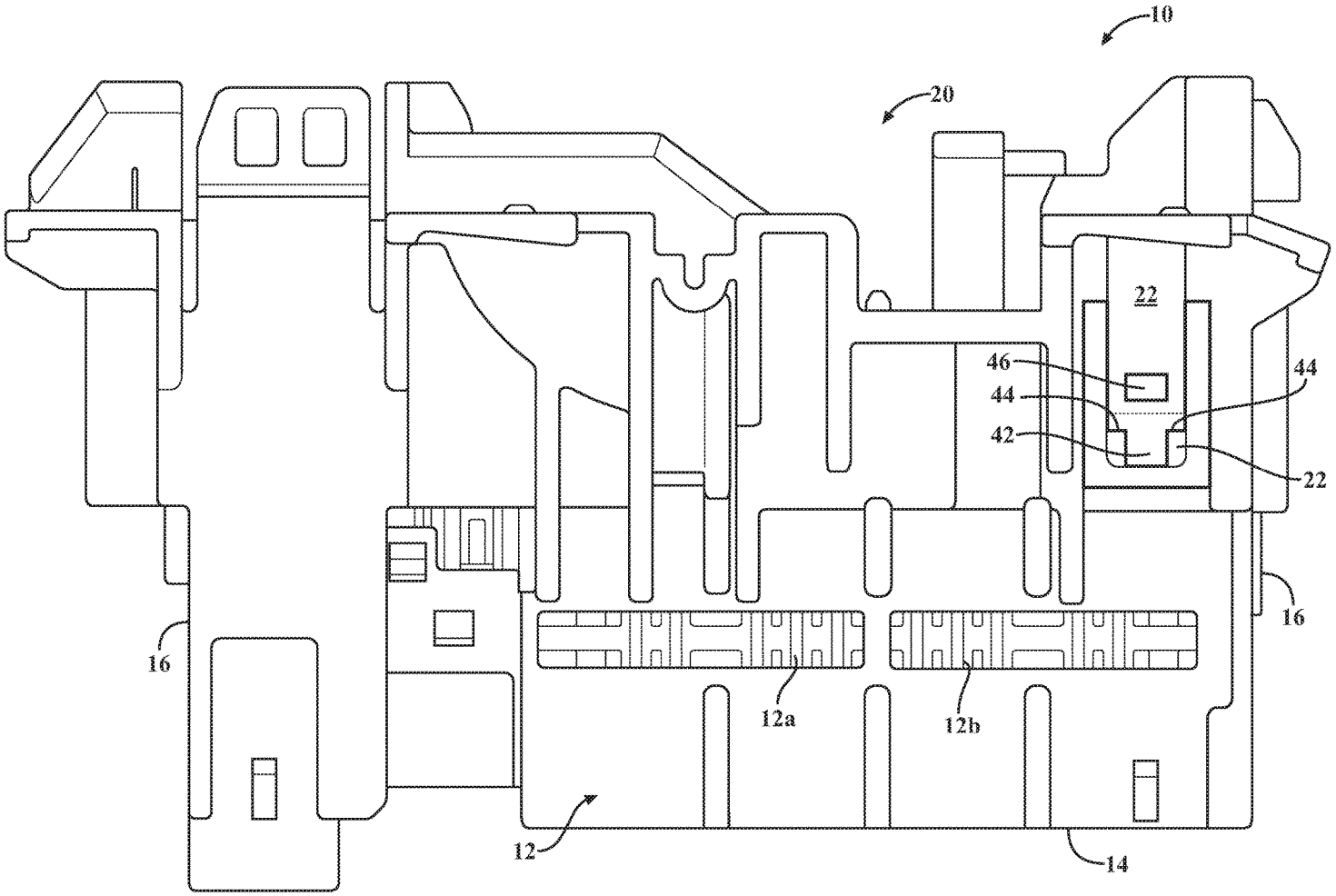
FIG. 1 is a side view of a connector housing.

A connector assembly for housing a coaxial connection and a terminal connection is provided. The connector assembly includes a male housing, a female housing and a lever mechanically coupling the male housing to the female housing so as to guide the male housing into the female housing at an angle.

The male housing includes a first support configured to fixedly hold the first coaxial cable end. The female housing includes a second support configured to fixedly hold the second coaxial cable end. The connector assembly is configured to guide the first coaxial cable end along an axis towards the second coaxial cable end. Accordingly, the sliding engagement between the shroud and the first support overcome the angled approach as the male housing is seated into the female housing by actuation of the lever. Thus, the first coaxial cable end is axially aligned with the second coaxial cable end so as to help prevent the first coaxial cable end from being misaligned with the second coaxial cable end when the male housing is seated into the female housing.

With reference now to FIGS. 1-7, a connector housing 10 is provided. The connector housing 10 may be formed by a tool having dies. The connector housing 10 may be made of a resilient material such as an injection molded plastic. The connector housing 10 includes a pair of side walls 12, a bottom wall 14 and a pair of end walls 16 so as to define an inner space 18 having a top opening 20.

Figure 1A:
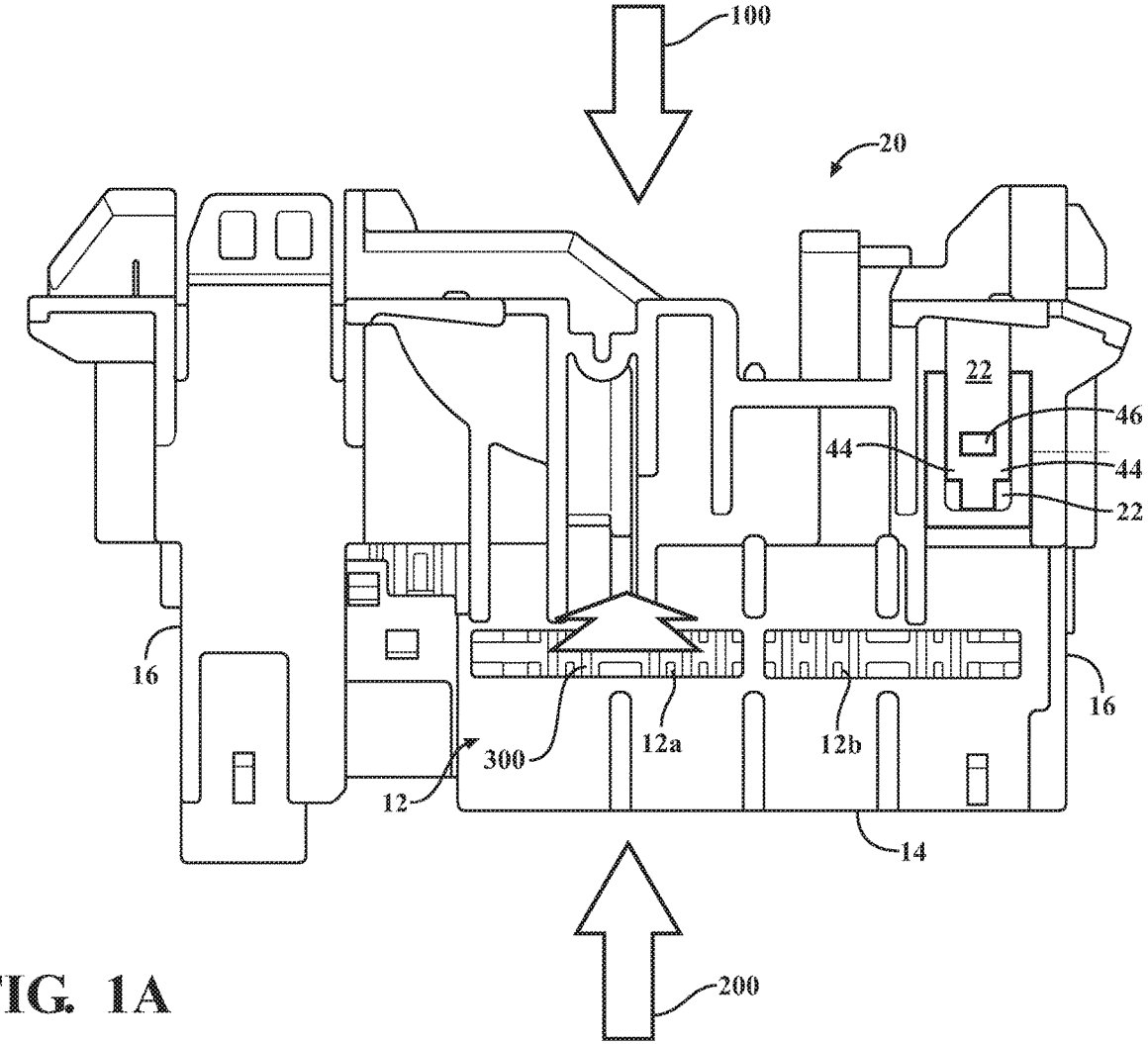
FIG. 1A is a view of FIG. 1 showing the dies.
Figure 4:
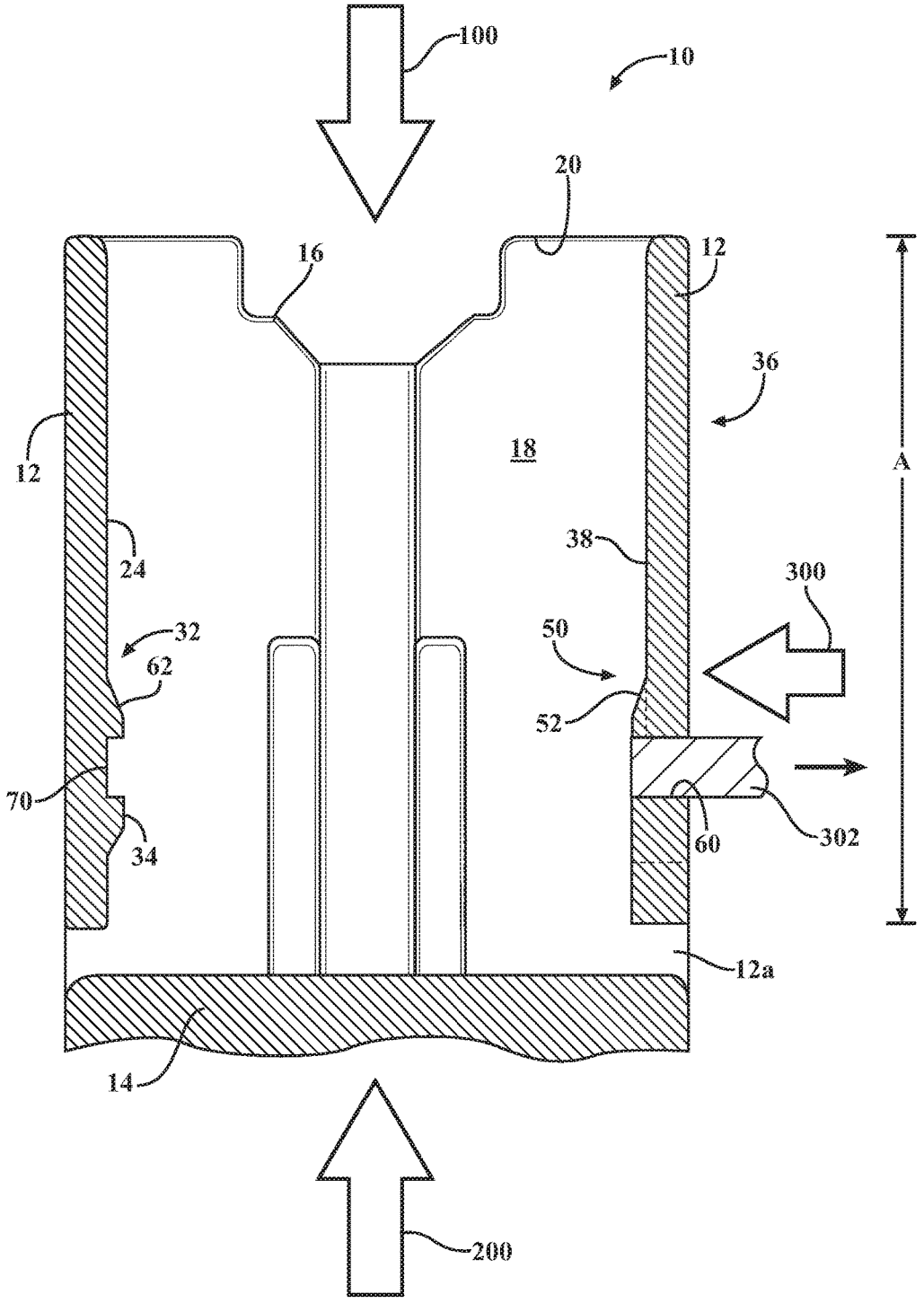
FIG. 4 is cross-sectional view of FIG. 1*a* taken along lines 4-4, showing a die forming the first blade slot.

FIG. 1 depicts a side view of the connector housing 10. The connector housing includes bottom slots 12*a*, 12*b* disposed on the side wall 12. FIG. 1*a* depicts the bottom slots 12*a*, 12*b* as well as other features of the connector housing 10 being formed by a first die 100, a second die 200 and a slide die 300. The dies 100, 200, and 300 are shown generally by arrows. The dies each have features corresponding to the portion of the connector housing 10, the dies form. FIG. 4 depicts the first die 100 forming the features of the inner space 18 of the connector housing 10. The second die 200 and the first die are pressed together wherein the bottom wall 14 is formed by the second die 200 working in concert with the first die 100. The side wall 12, is formed by the slide die 300 which is configured to form the bottom slots 12*a*, 12*b* as well as the pass-through slot 46 and the shoulders 44.

The connector housing 10 further includes a first clip 22 disposed on one of the pair of side walls 12. The first clip 22 includes a first elongated member 24. The first elongated member 24 includes a first interior surface 26 in open communication with the inner space 18. A first peripheral edge 28 of the first clip 22 is spaced apart from the side wall 12 so as to define a first slot 30 extending along the sides 22*a* and bottom edge 22*b* of the first clip 22. The first clip 22 further includes a first guide member 32 and a pair of first stops 34. The pair of first stops 34 is disposed on the first peripheral edge 28 of the first elongated member 24 and opposite of each other.

The connector housing 10 includes a second clip 36 disposed on a side wall 12, opposite of the first clip 22. The second clip 36 includes a second elongated member 38. The second elongated member 38 has a second interior surface 40 in open communication with the inner space 18. The second clip 36 further includes a neck 42 disposed on a distal end of the second elongated member 38 so as to define a pair of shoulders 44 on opposite sides of the neck 42.

The second clip 36 further including a pass-through slot 46. The pass-through slot 46 is disposed between the neck 42 and the top opening 20 of the housing. The pass-through slot 46 and the shoulders 44 allow a die 100 to form the engagement features on the first interior surface 26 of the first clip 22 so as to reduce the number of dies needed to form the connector housing 10.

Figure 2:
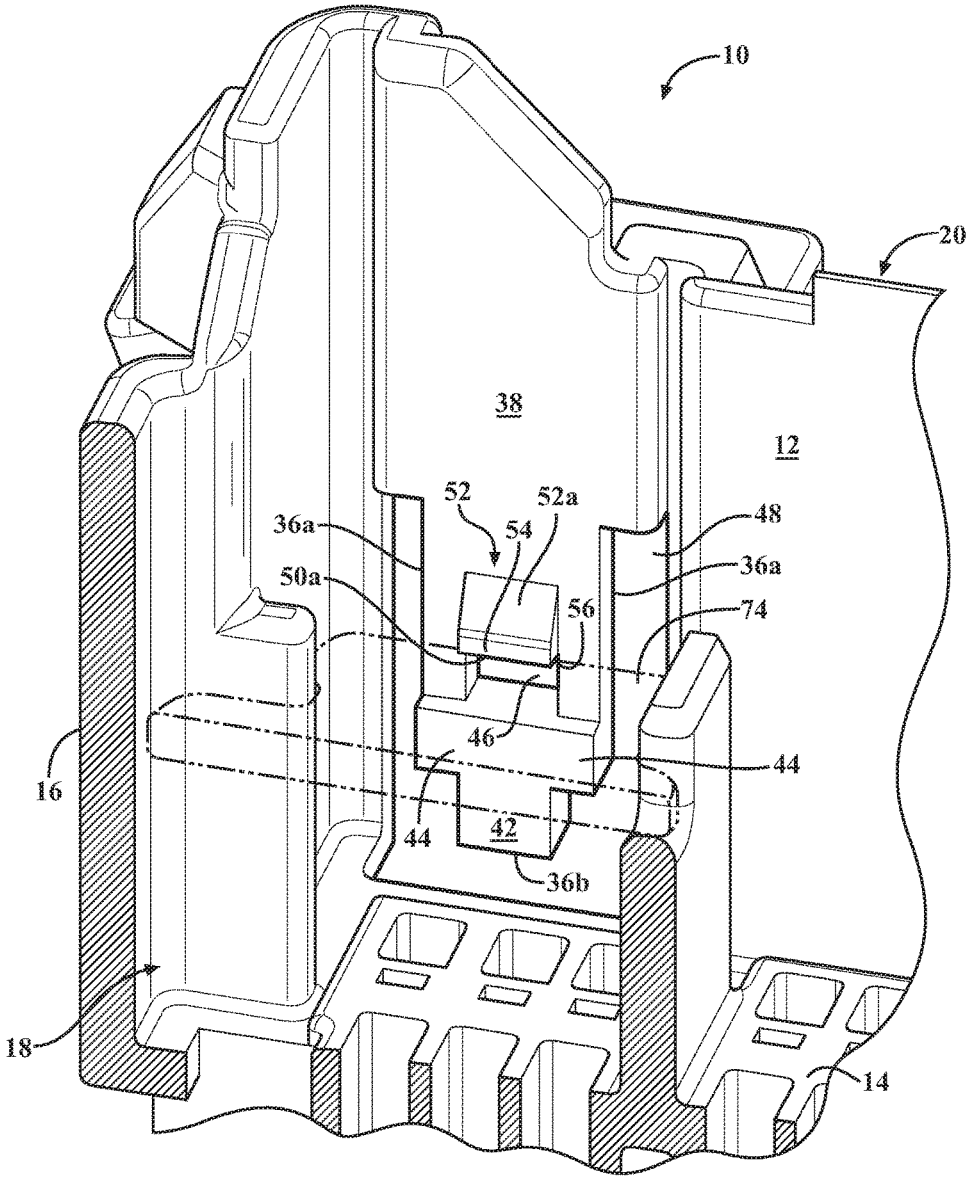
FIG. 2 is an isolated view of the second clip taken from the inner space of the connector housing.

With reference now to FIG. 2, an isolated view of the second clip 36 taken from the inner space 18 of the connector housing 10 is provided. The second clip 36 is integrally formed to the side wall 12, and is defined by a second peripheral slot 48 extending along the sides 36*a* and a bottom end 36*b* of the second clip 36.

The second clip 36 further includes a second guide member 50. The second guide member 50 includes a bottom edge 50*a* contiguous with the pass-through slot 46. The second guide member 50 has a second ramp 52. The second ramp 52 is defined by a surface 52*a* angled obtusely with respect to the second interior surface 40 of the second clip 36.

The second ramp 52 includes a second top surface 54 contiguous with the second ramp 52 and spaced apart from the second interior surface 40 of the side wall 12. The second ramp 52 further includes a second back wall 56. The second back wall 56 is generally orthogonal to the second interior surface 40.

FIG. 2 shows the neck 42 and shoulders 44 extending beyond the second interior surface 40 of the second elongated member 38 so as to define a second front wall 58. The second front wall 58 is opposite the second back wall 56 so as to define a second blade slot 60.

Figure 3:
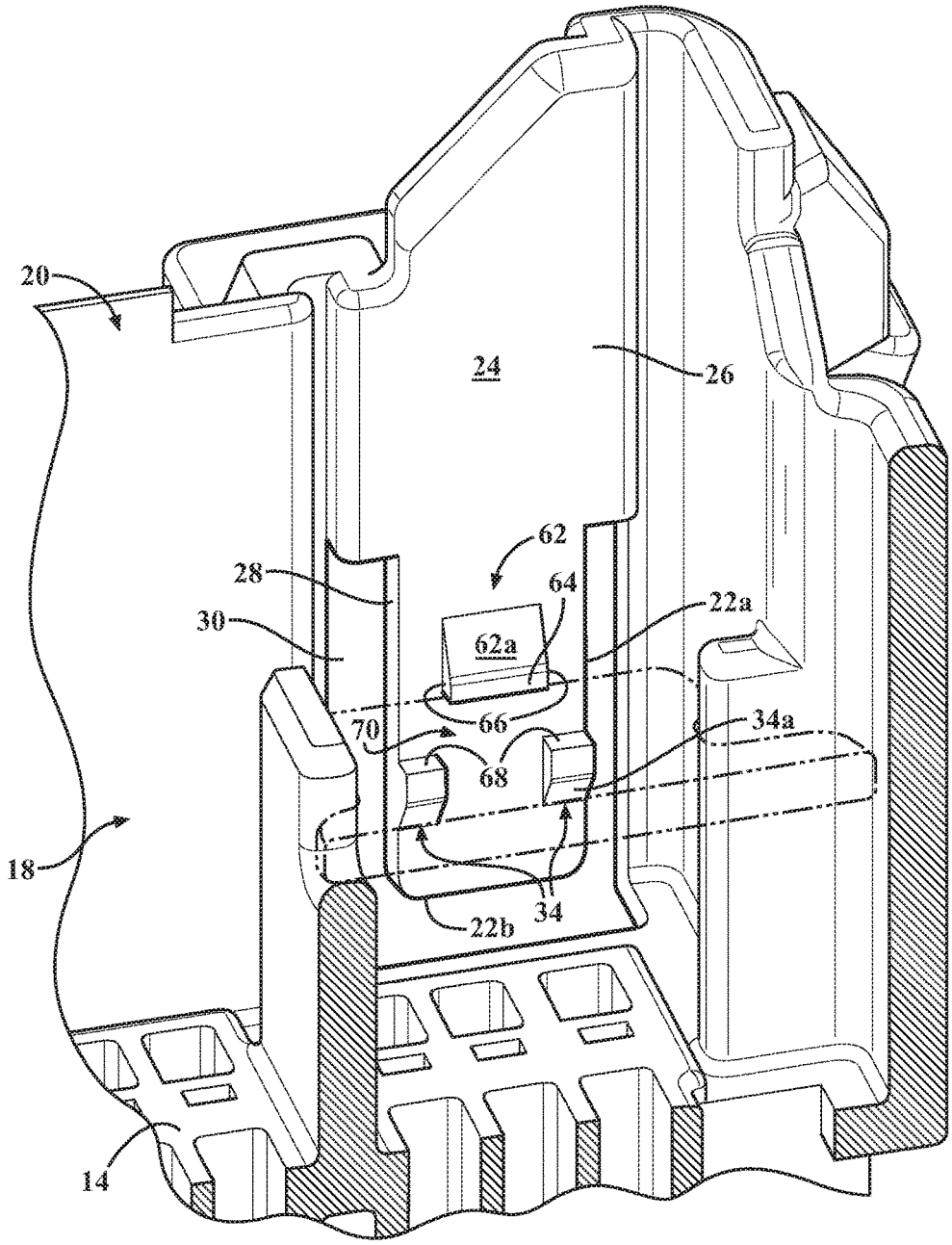
FIG. 3 is an isolated view of the first clip taken from the inner space of the connector housing.

With reference now to FIG. 3, an isolated view of the first clip 22 taken from the inner space 18 of the connector housing 10 is provide. The first guide member 32 has a first ramp 62. The first ramp 62 has a surface 62*a* angled obtusely with respect to the first interior surface 26. The first ramp 62 includes a first top surface 64 contiguous with the first ramp 62 and spaced apart from the first interior surface 26. The first ramp 62 further includes a first back wall 66. The first back wall 66 is generally orthogonal to the first interior surface 26.

Each of the pair of first stops 34 of the first guide member 32 includes a first front wall 68. The first front walls 68 are generally orthogonal to the first interior surface 26 and opposite the first back wall 66 so as to define a first blade slot 70. A posterior surface 34*a* of each of the pair of first stops 34 is ramp shaped.

FIG. 4 is a cross-sectional view of FIG. 1 taken along lines 4-4. FIG. 4 shows that first clip 22 and the second clip 36 are directly opposite each other. FIG. 4 also shows a first portion 302 of the slide die 300 forming the pass-through slot 46. The first portion 302 of the die 300 is a generally elongated rectangular member having a cross-section dimensioned to define the inner peripheral edge of the pass-through slot 46. The slide die 300 may further include a feature to form bottom slots 12*a*, 12*b*.

Figure 6:
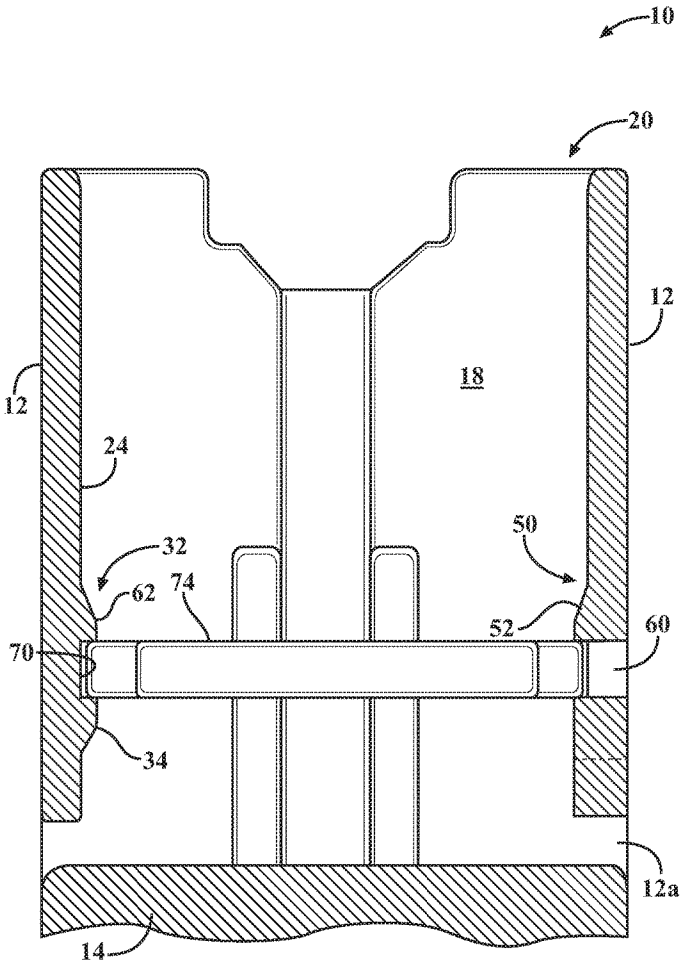
FIG. 6 is view of FIG. 5 showing the blade stabilizer held between the first and second clips.
Figure 5:
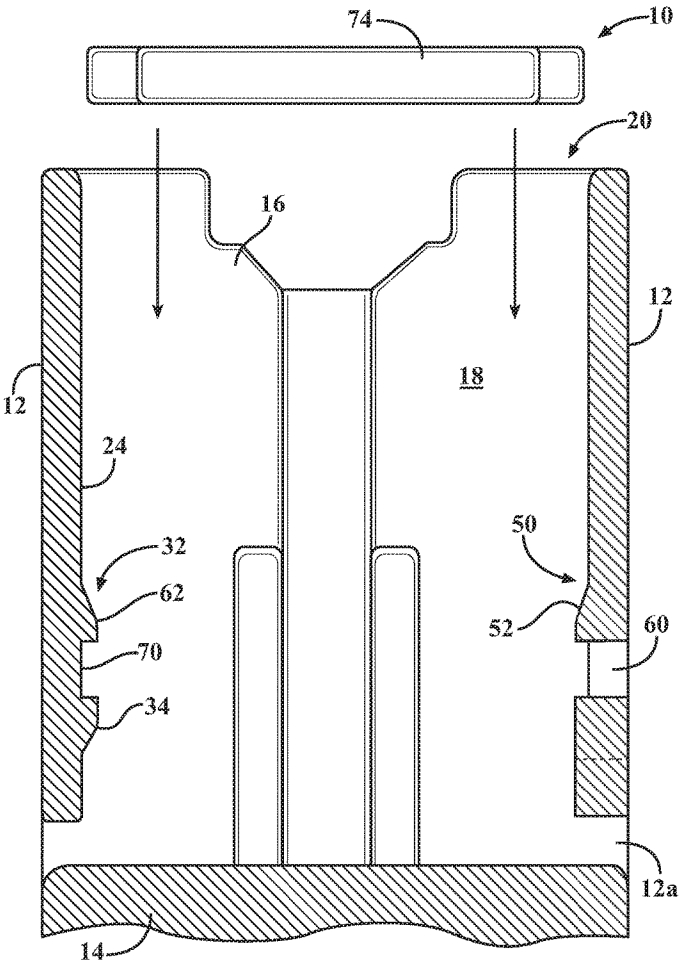
FIG. 5 is cross-sectional view of the connector housing showing the first and second clips and the male stabilizer.

With reference now to FIGS. 5 and 6, a connector assembly 72 having a blade stabilizer is provided. FIG. 5 is a cross-sectional view shown in FIG. 4 with the blade stabilizer 74 disposed above the opening 12. FIG. 6 is a view of FIG. 5 with the blade stabilizer 74 mounted within the inner space 18 of the connector housing 10. The connector assembly 72 is configured to house terminal connections. The terminal connections include a plurality of blades (not shown) for guiding a male terminal connector (not shown) into a female terminal connector (not shown).

The connector assembly 72 includes a blade stabilizer 74. The blade stabilizer 74 is a generally planar member having a plurality of through-holes for receiving a respective blades. Although the blades are not shown, it should be appreciated by those skilled in the art that the blades extend orthogonal to the planar body of the blade stabilizer 74 and are held within a respective through-hole. The blade stabilizer 74 has a first edge 74*a* opposite a second edge 74*b*. The first edge 74*a* and the second edge 74*b* are disposed on the opposite ends of the blade stabilizer 74.

The connector assembly 72 includes a connector housing 10. With reference again to FIG. 1, an illustrative view of the connector housing 10 is provided. The connector housing 10 includes a pair of side walls 12, a bottom wall 14 and a pair of end walls 16 so as to define an inner space 18 having a top opening 20.

With reference again to FIG. 3, the connector housing 10 further includes a first clip 22 disposed on one of the pair of side walls 12. The first clip 22 includes a first elongated member 24. The first elongated member 24 includes a first interior surface 26 in open communication with the inner space 18. A first peripheral edge 28 of the first clip 22 is spaced apart from the side wall 12 so as to define a first slot 30 extending along the sides 22*a* and bottom end 22*b* of the first clip 22. The first clip 22 further includes a first guide member 32 spaced apart from a pair of first stops 34 so as to define a first blade slot 70. The pair of first stops 34 are axially aligned with each other and disposed on the first peripheral edge 28 of the first elongated member 24 and opposite of each other.

With reference again to FIG. 2, the connector housing 10 further includes a second clip 36. The second clip 36 is disposed on the side wall 12 opposite the first clip 22. The second clip 36 is directly opposite the first clip 22.

The second clip 36 includes a second elongated member 38 having a second interior surface 40 in open communication with the inner space 18 of the connector housing 10. The second clip includes a second peripheral slot 48 separating the second elongated member 38 from the side wall 12. The second clip 36 includes a neck 42 disposed on a distal end of the second elongated member 38 so as to define a pair of shoulders 44 on opposite sides of the neck 42. The second clip 36 further includes a pass-through slot 46. The pass-through slot 46 is disposed between the neck 42 and the top opening 20 of the connector housing 10.

The second clip 36 further includes a second guide member 50 disposed on the second interior surface 40 of the connector housing 10. The second guide member 50 is opposite the first guide member 32. The second guide member 50 has a bottom edge 50*a* contiguous with the pass-through slot 46. The bottom edge 50*a* is spaced apart from the second front wall 58 of the shoulders 44 so as to define a second blade slot 60.

With reference again to FIG. 6, the first and second blade slots 70, 60 are shown engaging respective first and second blade edges so as to hold the blade stabilizer 74 within the inner space 18 of the connector housing 10. The blade stabilizer 74 is held in a generally horizontal position so as to be generally parallel to and spaced apart from the bottom wall 14 of the connector housing 10.

With reference again to FIGS. 2, 3 and 4, the first and the second guide members 32, 50 are symmetrical to each other. The first guide member 32 has a first ramp 62, a first top surface 64 contiguous with the first ramp 62 and spaced apart from the first interior surface 26, and a first back wall 66, the first back wall 66 generally orthogonal to the first interior surface 26. Each of the pair of first stops 34 of the first guide member 32 includes a first front wall 68. The first front walls 68 are generally orthogonal to the first interior surface 26 and opposite the first back wall 66 so as to define the first blade slot 70.

The second guide member 50 has a second ramp 52, a second top surface 54 contiguous with the second ramp 52. The second top surface 54 is also spaced apart from the second interior surface 40. The second guide member 50 further includes a second back wall 56. The second back wall 56 is generally orthogonal to the second interior surface 40. The neck 42 and shoulders 44 extend beyond the second interior surface 40 of the second elongated member 38 so as to define the second front wall 58. The second front wall 58 is opposite the second back wall 56 so as to define the second blade slot 60.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

We claim:

1. A connector housing comprising:

a pair of side walls, a pair of end walls and a bottom wall defining an inner space having a top opening;

a first clip disposed on one of the pair of side walls, the first clip having a first elongated member having a first interior surface in open communication with the inner space, a first peripheral edge of the first clip being spaced apart from the one of the pair of side walls, the first clip further including a first guide member and a pair of stops, the pair of stops disposed on the first peripheral edge of the first elongated member and opposite of each other; and a second clip disposed on the other of the pair of side walls, the second clip having a second elongated member having a second interior surface in open communication with the inner space, a neck disposed on a distal end of the second elongated member so as to define a pair of shoulders on opposite sides of the neck, the second clip further including a pass-through slot, the pass-through slot disposed between the neck and the top opening of the housing, the pass-through slot and the shoulders reducing a number of tool dies needed to form the connector housing.

2. The connector housing as set forth in claim 1, wherein the second clip includes a second guide member, the second guide member having a bottom edge contiguous with the pass-through slot.

3. The connector housing as set forth in claim 2, wherein the first clip and the second clip are directly opposite each other.

4. The connector housing as set forth in claim 3, wherein the first and the second guide members are symmetrical to each other.

5. The connector housing as set forth in claim 4, wherein the first guide member has a first ramp, a first top surface contiguous with the first ramp and spaced apart from the first interior surface, and a first back wall, the first back wall generally orthogonal to the first interior surface.

6. The connector housing as set forth in claim 5, wherein each of the pair of stops of the first guide members includes a first front wall, the first front walls generally orthogonal to the first interior surface and opposite the first back wall so as to define a first blade slot.

7. The connector housing as set forth in claim 6, wherein the second guide member has a second ramp, a second top surface contiguous with the second ramp and spaced apart from the second interior surface, and a second back wall, the second back wall generally orthogonal to the second interior surface.

8. The connector housing as set forth in claim 7, wherein the neck and shoulders extend beyond the second interior surface of the second elongated member so as to define a second front wall, the second front wall opposite the second back wall so as to define a second blade slot.

9. A connector assembly configured to house terminal connections, the terminal connections including a plurality of blades for guiding a male terminal connector into a female terminal connector, the connector assembly comprising:

a blade stabilizer, the blade stabilizer being a generally planar member having a plurality of through-holes for receiving a respective one of the plurality of blades, the blade stabilizer having a first edge opposite a second edge;

a housing a pair of side walls, a pair of end walls and a bottom wall defining an inner space having a top opening, the housing further including a first clip and a second clip, the first clip is disposed on one of the pair of side walls, the second clip is disposed on the other of the pair of side walls opposite the first clip, wherein the first clip includes a first elongated member having a first interior surface in open communication with the inner space, a first peripheral edge of the first clip being spaced apart from the one of the pair of side walls, the first clip further including a first guide member spaced apart from a pair of stops so as to define a first blade slot, the pair of stops disposed on the first peripheral edge of the first elongated member and opposite of each other, the second clip including a second elongated member having a second interior surface in open communication with the inner space, a neck disposed on a distal end of the second elongated member so as to define a pair of shoulders on opposite sides of the neck, the second clip including a pass-through slot, the pass-through slot disposed between the neck and the top opening of the housing, the second clip further including a second guide member opposite the first guide member, the second guide member having a bottom edge contiguous with the pass-through slot, the bottom edge spaced apart from the second front wall of the shoulders so as to define a second blade slot, wherein the first blade slot is configured to engage the first blade edge and the second blade slot is configured to engage the second blade edge so as to hold the blade stabilizer in a generally horizontal position so as to be generally parallel to and spaced apart from the bottom wall.

10. The connector assembly as set forth in claim 9, wherein the first and the second guide members are symmetrical to each other.

11. The connector assembly as set forth in claim 10, wherein the first guide member has a first ramp, a first top surface contiguous with the first ramp and spaced apart from the first interior surface, and a first back wall, the first back wall generally orthogonal to the first interior surface.

12. The connector housing as set forth in claim 11, wherein each of the pair of stops of the first guide members includes a first front wall, the first front walls generally orthogonal to the first interior surface and opposite the first back wall so as to define the first blade slot.

13. The connector housing as set forth in claim 12, wherein the second guide member has a second ramp, a second top surface contiguous with the second ramp and spaced apart from the second interior surface, and a second back wall, the second back wall generally orthogonal to the second interior surface.

14. The connector housing as set forth in claim 13, wherein the neck and shoulders extend beyond the second interior surface of the second elongated member so as to define the second front wall, the second front wall opposite the second back wall so as to define the second blade slot.

* * * * *